US006702588B1

(12) United States Patent
McHugh et al.

(10) Patent No.: US 6,702,588 B1
(45) Date of Patent: Mar. 9, 2004

(54) ELECTRICAL CONNECTOR ASSEMBLY WITH SNAP-FIT BASE AND FRAME

(75) Inventors: Robert G. McHugh, Golden, CO (US); Fang-Jwu Liao, Tu-Chen (TW)

(73) Assignee: Hon Hai Precision Ind. Co., Ltd., Taipei Hsine (TW)

( * ) Notice: Subject to any disclaimer, the term of this patent is extended or adjusted under 35 U.S.C. 154(b) by 0 days.

(21) Appl. No.: 10/442,704

(22) Filed: May 20, 2003

(51) Int. Cl.[7] ..... H01R 12/00
(52) U.S. Cl. ..... 439/71; 439/331; 439/525
(58) Field of Search ..... 439/66, 71, 72, 439/73, 91, 330, 331, 525, 526, 573, 564

(56) References Cited

U.S. PATENT DOCUMENTS 5,344,334 A 9/1994 Laub et al.
5,713,744 A * 2/1998 Laub ..... 439/71
6,174,182 B1 * 1/2001 Kuo ..... 439/181
6,196,849 B1 * 3/2001 Goodwin ..... 439/71

* cited by examiner

*Primary Examiner*—Tho D. Ta
*Assistant Examiner*—James R. Harvey
(74) *Attorney, Agent, or Firm*—Wei Te Chung

(57) ABSTRACT

An electrical connector assembly (1) includes a base (11) receiving a number of electrical contacts, and a frame (12) assembled on the base. The frame defines an opening (121) in a middle thereof for receiving a CPU (3) therein, two fixing holes (123) at diagonally opposite corners thereof, and two semi-circular orientation holes (122) at two opposite sides thereof. The base includes a planar portion (111) having a top surface (115) and a bottom surface (114). Two orientation projections (119) are formed at the top surface, for interferentially engaging with the orientation holes. Two forked fixing posts (116) are formed at the top surface, for snappingly engaging in the fixing holes of the frame to mount the frame on the base. Two protrusions (117) are formed at the bottom surface, for interferentially engaging in corresponding bores (21) of a PCB (2) to mount the electrical connector assembly on the PCB.

4 Claims, 4 Drawing Sheets

ELECTRICAL CONNECTOR ASSEMBLY WITH SNAP-FIT BASE AND FRAME

BACKGROUND OF THE INVENTION

1. Field of the Invention

The present invention relates to an electrical connector assembly for electrically connecting an electronic package such as a central processing unit (CPU) with a circuit substrate such as a printed circuit board (PCB), and particularly to a land grid array (LGA) connector assembly having a base and a frame readily joined together.

2. Description of the Prior Art

Electrical connector assemblies are widely used for electrically connecting land grid array (LGA) central processing units (CPUs) with printed circuit boards (PCBs). This kind of connector assembly is described in "Nonlinear Analysis Helps Design LGA Connectors", which is obtained from the web journal "Connector Specifier" (February, 2001). A similar electrical connector assembly is disclosed in U.S. Pat. No. 5,344,334.

Generally, each such conventional electrical connector assembly is mounted on a PCB that defines four bores. The electrical connector assembly comprises a base receiving a plurality of electrical contacts therein, and a frame assembled on the base. The frame defines an opening in a middle thereof, and four screw holes at respective corners thereof. The base defines a plurality of passageways receiving the contacts therein, and four holes corresponding to the screw holes of the frame. In assembly, the base is attached on the PCB, with the holes of the base above the corresponding bores of the PCB. The frame is attached on the base, with the screw holes above the corresponding holes of the base. Four bolts are extended through respective bores of the PCB and respective holes of the base to engage in respective screw holes of the frame, thereby assembling the electrical connector assembly with the PCB.

However, it takes an unduly long time to screw the bolts when assembling the electrical connector assembly with the PCB. This retards the efficiency of assembly, which is particularly significant in mass production facilities. In addition, the base and the frame are at all times separate parts prior to their assembly on the PCB. This increases the difficulty of transporting and handling the base and the frame.

In view of the above, a new LGA connector assembly that overcomes the above-mentioned disadvantages is desired.

SUMMARY OF THE INVENTION

Accordingly, a main object of the present invention is to provide an electrical connector assembly for electrically connecting a CPU and a PCB, wherein the connector assembly can be readily assembled on the PCB.

Another object of the present invention is to provide an electrical connector assembly having a base and a frame that can be assembled together prior to mounting of the electrical connector assembly on a PCB.

To achieve the above-mentioned objects, an electrical connector assembly in accordance with a preferred embodiment of the present invention is mounted on a PCB that defines two bores diagonally opposite from each other. The electrical connector assembly comprises a base, a plurality of electrical contacts received in the base, and a frame assembled on the base. The frame defines an opening in a middle thereof, two fixing holes at diagonally opposite corners thereof, and two semi-circular orientation holes at two opposite sides thereof. The fixing hole is surrounded by a circumferential step thereat. The frame includes a planar portion having a top surface and a bottom surface. A pair of orientation projection extends perpendicularly from the top surface of the planar portion, for interferentially engaging in the orientation holes of the frame. A pair of fixing posts extends perpendicularly from the top surface of the planar portion, for snappingly engaging in the fixing holes of the frame to firmly mount the frame on the base. A pair of protrusions is located below respective orientation projections, with the protrusions depending from the bottom surface of planar portion. The protrusions interferentially engage in the bores of the PCB to firmly mount the electrical connector assembly on the PCB.

Other objects, advantages and novel features of the invention will become more apparent from the following detailed description when taken in conjunction with the accompanying drawings, in which:

DETAILED DESCRIPTION OF THE PREFERRED EMBODIMENT OF THE INVENTION

Reference will now be made to the drawings to described the present invention in detail.

Figure 1:
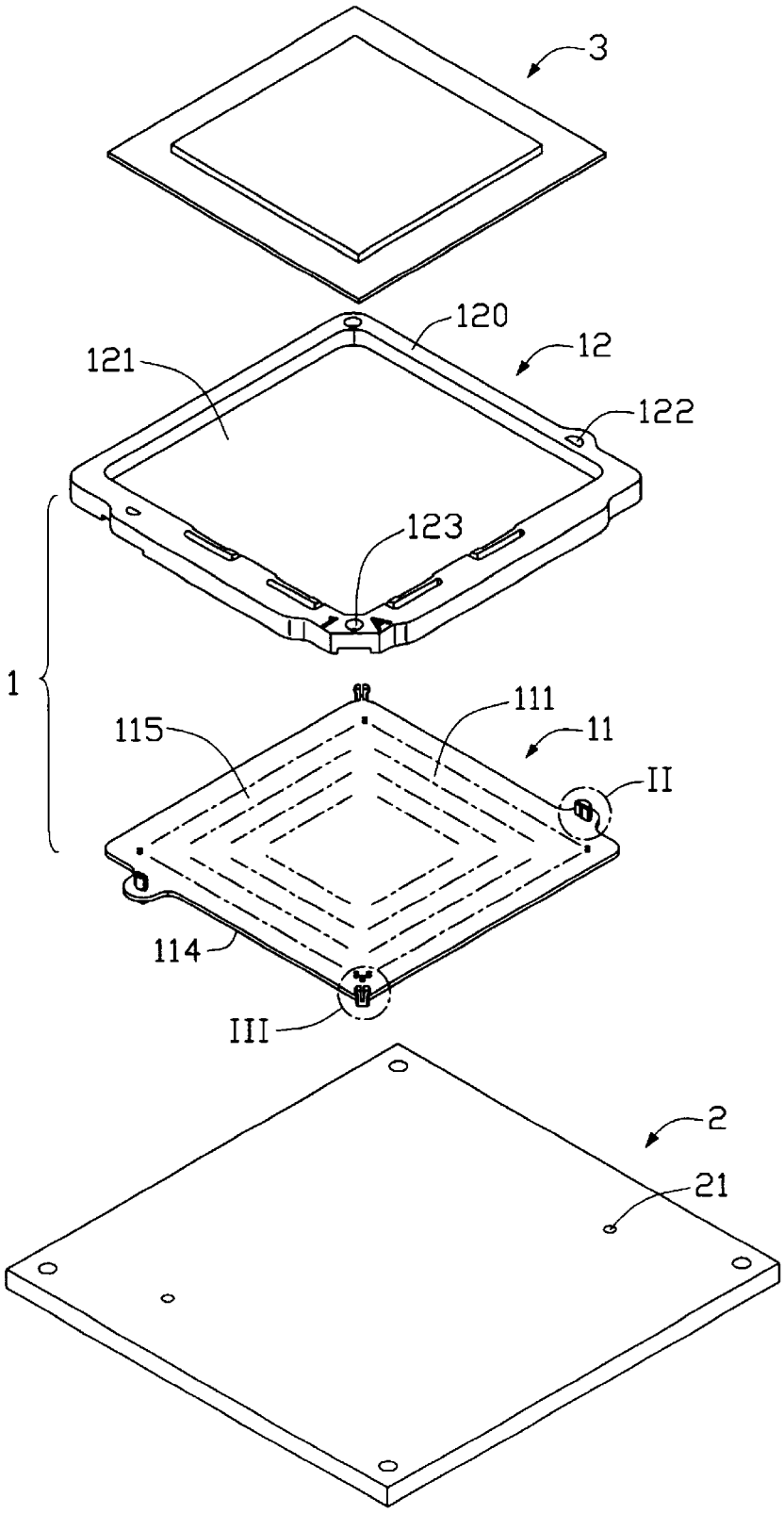
FIG. 1 is a simplified, exploded isometric view of an electrical connector assembly in accordance with the preferred embodiment of the present invention, together with an LGA CPU and a PCB.
Figure 2:
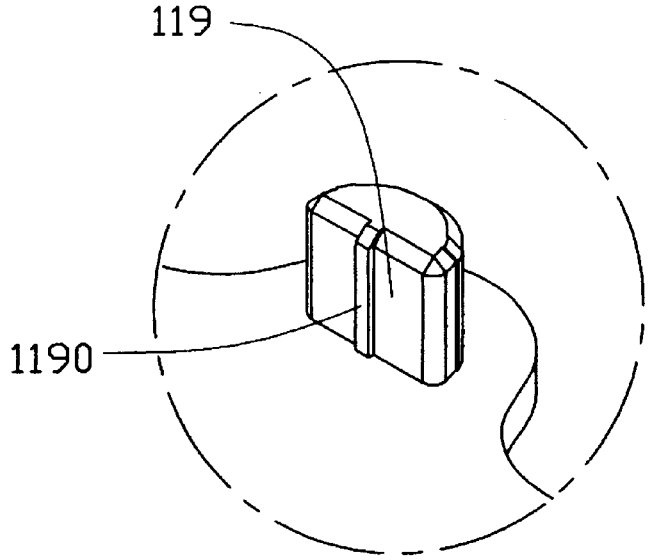
FIG. 2 is an enlarged view of a circled portion II of FIG. 1.
Figure 3:
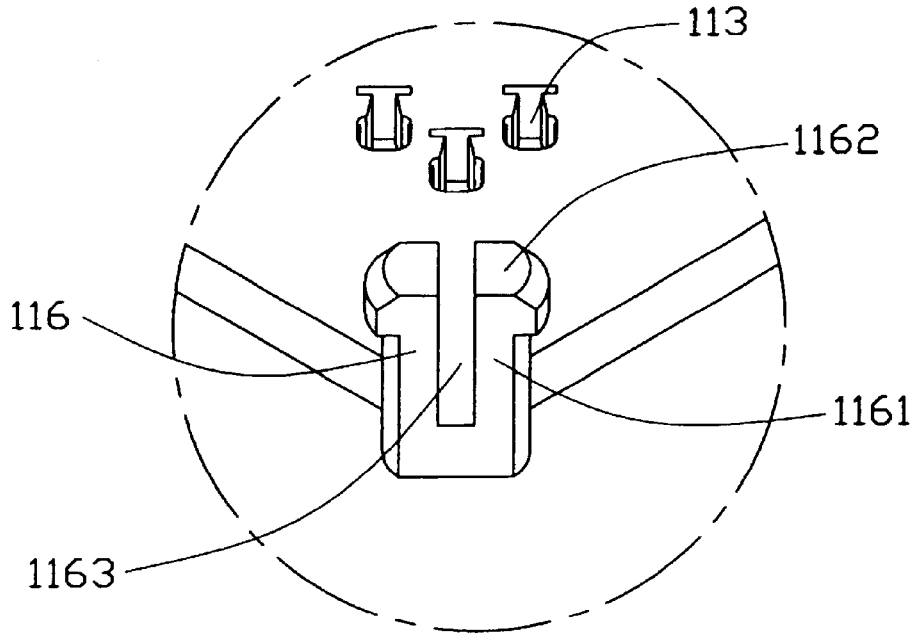
FIG. 3 is an enlarged view of a circled portion III of FIG. 1.
Figure 4:
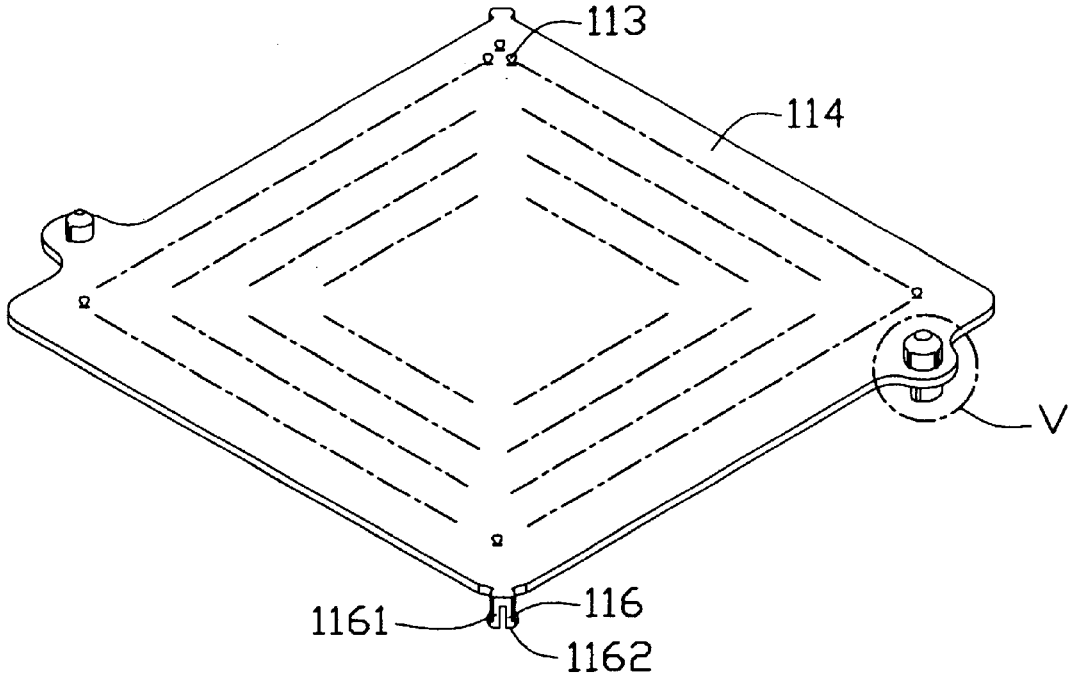
FIG. 4 is a simplified, isometric view of a base of the electrical connector assembly of FIG. 1, but showing the base inverted.
Figure 5:
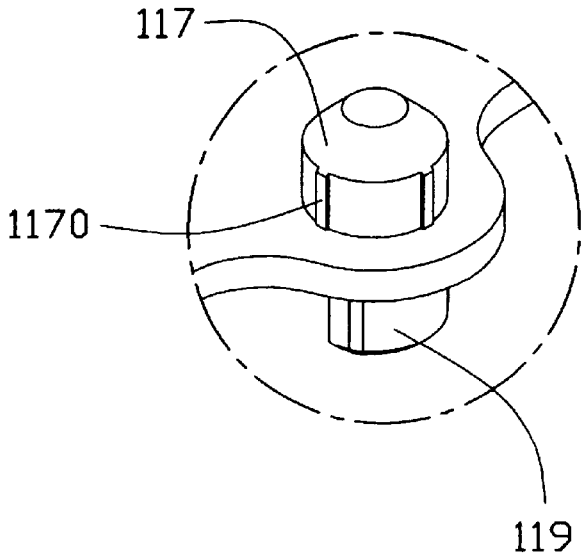
FIG. 5 is an enlarged view of a circled portion V of FIG. 4.

Referring to FIG. 1, an electrical connector assembly 1 of the present invention is used for electrically connecting a land grid array (LGA) central processing unit (CPU) 3 with a printed circuit board (PCB) 2. The PCB 2 defines two bores 21, which are generally diagonally opposite from each other. The electrical connector assembly 1 comprises a base 11, a plurality of electrical contacts (not shown) received in the base 11, and a frame 12 assembled on the base 11.

Also referring to FIGS. 2, 3, 4 and 5, the base 11 comprises a planar portion 111, and a pair of forked fixing posts 116, a pair of orientation projections 119 and a pair of protrusions 117 respectively extending from the planar portion 111. The planar portion 111 has a top surface 115, and a bottom surface 114 opposite to the top surface 115. The planar portion 111 defines a plurality of passageways 113 extending therethrough. The passageways 113 are arranged in a rectangular array for respectively receiving the contacts therein. The fixing posts 116 are formed at diagonally opposite corners of the planar portion 111. Each fixing post 116 comprises a body portion 1161 extending perpendicularly from a respective corner of the planar portion 111, a cap

1162 on a top of the body portion 1161, and a vertical slot 1163. The slot 1163 bifurcates the cap 1162 and the body portion 1161, thus providing the fixing post 116 with elasticity in transverse directions during assembly. The orientation projections 119 are formed at two opposite sides of the planar portion 111. Each orientation projection 119 extends perpendicularly upwardly from the top surface 115. Each orientation projection 119 has a generally semi-circular horizontal cross-section, and comprises a plurality of spaced, vertical first ribs 1190 around a periphery thereof. Each protrusion 117 is generally cylindrical with a frustum-shaped free end, and comprises a plurality of vertical second ribs 1170 around a periphery thereof. The protrusions 117 are located below respective orientation projections 119, with the protrusions 117 depending from the bottom surface 114.

The frame 12 is substantially rectangular, with four beams 120 defining an opening 121 therebetween for receiving the CPU 3 therein. Each of two opposite of the beams 120 defines a semi-circular orientation hole 122 therethrough, the orientation holes 122 corresponding to the orientation projections 119 of the base 11. The frame 12 defines two fixing holes 123 at diagonally opposite corners thereof, the fixing holes 123 corresponding to the fixing posts 116 of the base 11. Each fixing hole 123 is surrounded by a circumferential step (not shown) thereat.

Figure 6:
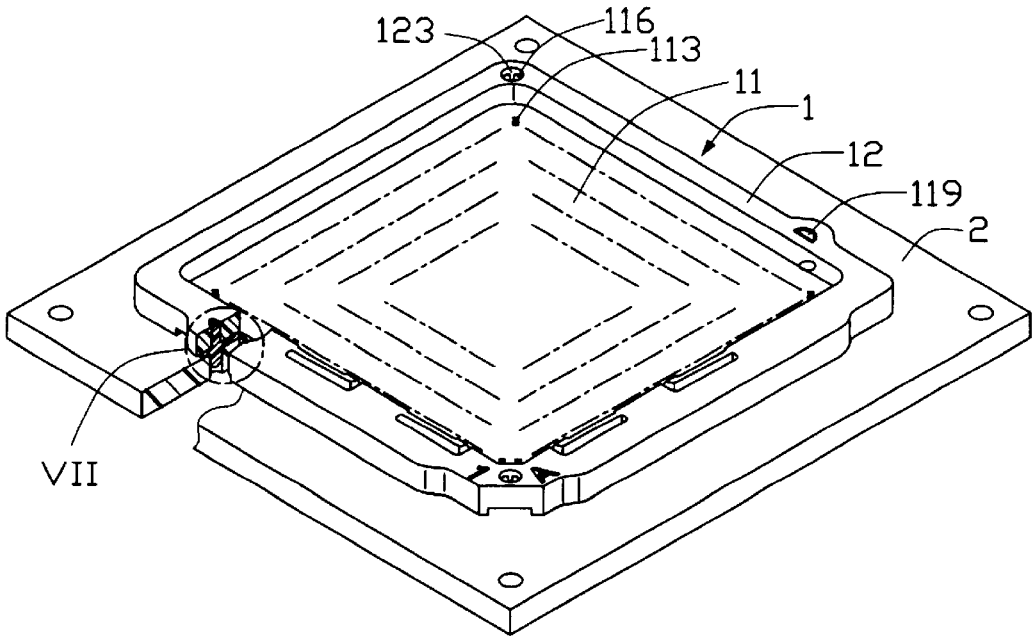
FIG. 6 is an assembled view of the electrical connector assembly and the PCB of FIG. 1, partly cut away.
Figure 7:
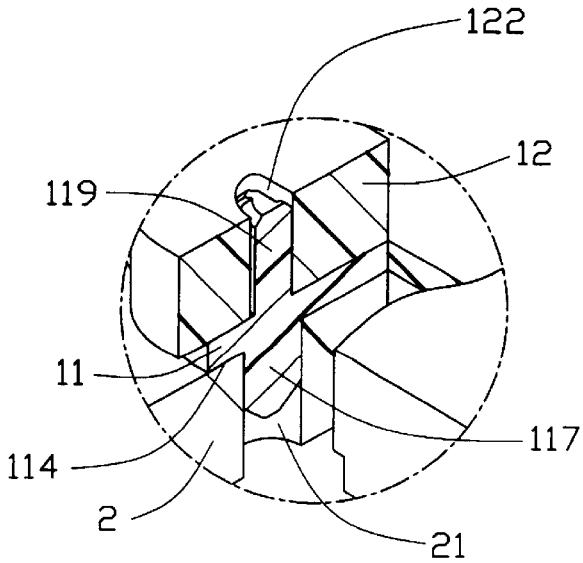
FIG. 7 is an enlarged view of a circled portion VII of FIG. 6.

Referring to FIGS. 6 and 7, in assembly of the base 11 and the frame 12, the frame 12 is positioned above the base 11, with the orientation projections 119 beneath the corresponding orientation holes 122, and the fixing posts 116 beneath the corresponding fixing holes 123. Then the frame 12 is pushed down onto the base 11, and the fixing posts 116 elastically deform. When the fixing posts 116 are fully received in the fixing holes 123 and the orientation projections 119 are fully received within the orientation holes 122, the fixing posts 116 elastically rebound to their original shapes. The caps 1162 of the fixing posts 116 abut against corresponding steps of the fixing holes 123. The first ribs 1190 interferentially engage the orientation projections 119 in the orientation holes 122. The frame 12 is thereby firmly mounted on the base 11.

In assembly of the electrical connector assembly 1 and the PCB 2, the electrical connector assembly 1 is positioned above the PCB 2, with the protrusions 117 of the base 11 above the corresponding bores 21 of the PCB 2. The electrical connector assembly 1 is pushed down onto the PCB 2. The second ribs 1170 interferentially engage the protrusions 117 in the bores 21. The electrical connector assembly 1 is thereby firmly mounted on and electrically connected with the PCB 2. When the CPU 3 is mounted in the opening 121 of the frame 12, the CPU 3 is firmly engaged on the planar portion 111 of the base 11 by retention means such as a clip assembly (not shown). The CPU 3 is thus electrically connected with the PCB 2.

While a preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical connector assembly comprising:

a plurality of electrical contacts; a base comprising:

a planar portion having a top surface and a bottom surface opposite to the top surface, the planar portion defining a plurality of passageway for respectively receiving the contacts therein;

a plurality of forked fixing posts formed at the top surface of the planar portion, each fixing post comprising a body portion depending perpendicularly from the top of the planar portion, and a cap on a top of the body portion;

a plurality of orientation projections depending from the top; and a frame defining a rectangular opening in a middle thereof, a plurality of fixing holes snappingly engaging the fixing posts of the base, and a plurality of orientation holes interferentially engaging the orientation projections;

wherein there are two orientation projections at two opposite sides of the planar portion;

wherein each projection has a semi-circular horizontal cross-section and has a plurality of spaced, vertical first ribs around a periphery thereof;

wherein there are two orientation holes at two opposite sides of the frame;

wherein a plurality of protrusions located below respective orientation projections, with the protrusions depending from the bottom surface of the planar portion;

wherein each of the protrusions is generally cylindrical with a frustum-shaped free end, and comprises a plurality of vertical second ribs around a periphery thereof for interferentially engaging the protrusion in a bore of a PCB.

2. The electrical connector assembly as claimed in claim 1, wherein there are two fixing posts at diagonally opposite corners of the planar portion.

3. The electrical connector assembly as claimed in claim 2, wherein each fixing post has a vertical slot bifurcating the cap and the body portion to provide the fixing post with elasticity in transverse direction during assembly.

4. The electrical connector assembly as claimed in claim 2, wherein there are two fixing holes at diagonally opposite corners of the frame.

* * * * *